US008127584B2

(12) United States Patent
Guo

(10) Patent No.: US 8,127,584 B2
(45) Date of Patent: Mar. 6, 2012

(54) PRESTRESSED ROLLING MILL HOUSING ASSEMBLY WITH IMPROVED OPERATIONAL FEATURES

(75) Inventor: Remn-Min Guo, Meriden, CT (US)

(73) Assignee: I2S, LLC, Yalesville, CT (US)

( * ) Notice: Subject to any disclaimer, the term of this patent is extended or adjusted under 35 U.S.C. 154(b) by 88 days.

(21) Appl. No.: 12/818,800

(22) Filed: Jun. 18, 2010

(65) Prior Publication Data

US 2010/0251793 A1 Oct. 7, 2010

Related U.S. Application Data

(62) Division of application No. 11/961,597, filed on Dec. 20, 2007, now Pat. No. 7,765,844.

(51) Int. Cl.
*B21B 29/00* (2006.01)

(52) U.S. Cl. ..... 72/242.4; 72/7.1; 72/10.7; 72/245; 72/248; 72/366.2; 100/161

(58) Field of Classification Search ..... 72/7.1, 72/7.2, 8.1, 10.1, 10.7, 11.1, 12.1, 237, 238, 72/241.2, 242.2, 242.4, 245, 248, 366.2; 700/148, 150; 100/161, 170

See application file for complete search history.

(56) References Cited

U.S. PATENT DOCUMENTS

| | | | | |
|---|---|---|---|---|
| 2,187,250 | A | 1/1940 | Sendzimir | |
| 2,368,030 | A * | 1/1945 | Larsson | 72/242.4 |
| 2,776,586 | A | 1/1957 | Sendzimir | |
| 3,076,360 | A | 2/1963 | Sendzimir | |
| 3,169,423 | A * | 2/1965 | Sims | 72/242.4 |
| 3,858,424 | A | 1/1975 | Kajiwara et al. | |
| 4,156,359 | A | 5/1979 | Verbickas | |
| 4,309,893 | A | 1/1982 | Mueller | |
| 4,890,475 | A | 1/1990 | Baltschun | |
| 5,142,896 | A | 9/1992 | Berger et al. | |
| 5,355,707 | A | 10/1994 | Inoue et al. | |
| 5,421,184 | A | 6/1995 | Sendzimir et al. | |
| 5,471,859 | A | 12/1995 | Sendzimir et al. | |
| 5,596,899 | A | 1/1997 | Sendzimir et al. | |
| 5,666,844 | A | 9/1997 | Beiber | |
| 5,857,372 | A | 1/1999 | Sendzimir et al. | |
| 5,996,388 | A | 12/1999 | Mantovan et al. | |
| 6,116,073 | A | 9/2000 | Kajiwara et al. | |
| 6,260,397 | B1 | 7/2001 | Zheng et al. | |
| 6,725,701 | B2 | 4/2004 | Nakayama et al. | |
| 7,032,424 | B2 * | 4/2006 | Schunn et al. | 72/247 |

FOREIGN PATENT DOCUMENTS

| | | | |
|---|---|---|---|
| EP | 0445566 | A1 * | 9/1991 |
| EP | 0 998 992 | B1 | 7/2004 |

* cited by examiner

*Primary Examiner* — Edward Tolan

(57) ABSTRACT

The present invention provides a Cluster mill which utilizes a Cluster mill gauge control system, has a high mill stiffness, a large work roll gap for threading, a rapid work roll gap opening, accurate roll force computation, side to side tilting, and utilizes work rolls over a much wider diameter range.

27 Claims, 9 Drawing Sheets

PRESTRESSED ROLLING MILL HOUSING ASSEMBLY WITH IMPROVED OPERATIONAL FEATURES

CROSS REFERENCE TO RELATED APPLICATIONS

The present application is a divisional application of and claims priority to U.S. patent application Ser. No. 11/961,597 filed on Dec. 20, 2007, now U.S. Pat. No. 7,765,844 entitled "Prestressed Rolling Mill Housing Assembly With Improved Operational Features," which is incorporated herein by reference.

STATEMENT REGARDING FEDERALLY SPONSORED RESEARCH OR DEVELOPMENT

Not applicable.

REFERENCE TO SEQUENCE LISTING, A TABLE, OR COMPUTER PROGRAM LISTING

Not applicable.

BACKGROUND OF THE INVENTION (1) Field of the Invention

This application is directed to improvements in rolling mill housings used in rolling operations in the flat rolled metal industry. In particular, the present invention is directed toward a multi-roll cluster type of rolling mill.

(2) Description of Related Art

Cluster mills are popular in the rolling mill industry when a high gauge reduction is taken, a thin exit gauge is rolled, or a combination of the two. A cluster mill provides many advantages to the operation of a rolling mill and includes the following: small diameter work rolls, high housing stiffness, and a simplified gauge control. In many previous applications, the cluster mill housing has been built based on a mono block design, such as seen and described in U.S. Pat. Nos. 5,421,184, 2,187,250 in FIG. 8, and U.S. Pat. No. 2,776,586 in FIG. 8.

In particular, the centerline gauge (or thickness) control is excellent due to the high mill stiffness where any entry gauge increase is immediately met with a higher rolling force. The gauge control is very simple and supplied by rotating eccentric bearings on a support roll to adjust the roll gap. The developed rolling force is transferred to the mono block housing through the roll saddles at various angles which add to the mill stiffness. The rolling force is not thereby transferred into the mono block housing in the vertical direction only.

Though a Cluster mill has historically been attractive for many rolling applications, there is a need for improved flexibility in the rolling operation. One disadvantage to using a Cluster mill is a very small roll gap opening when there is a strip breakage. After a strip break, the improperly rolled metal strip is called a cobble. In many cases, a cobble results in many pieces of metal strip remaining within the mono block, and pieces of the cobble wrap around various rolls in the cluster roll arrangement. A cobble is a common, though infrequent, event during the rolling operation. Depending upon how quickly the entry side metal strip can be stopped, there may be damage to the rolls and ancillary equipment with a significant amount of metal strip to remove. Removal can take from several minutes to several hours depending upon the extent of damage to the rolls and other equipment. Sometimes, it is very difficult to remove the cluster mill rolls from the mono block due to jamming from broken strip. The ability to open the work rolls to a wide gap quickly in the event of a sudden strip tension loss, which indicates a strip break, would greatly help prevent cobbles from causing rolling mill damage. The desired opening gap to minimize damage is higher than currently available with the mono block work roll movement.

In addition, the Cluster mill has a limited range of work roll diameters that will operate within the design of the mono block. This lowers economic appeal. Work rolls are normally surface refinished by regrinding when they are worn out, and a limiting operating range makes reuse by grinding very limited.

Another disadvantage of the Cluster mill is the reduced ability to be flexible for a varied rolling operation. It is highly desirable in some commercial settings to have a single rolling mill capable of cold rolling with a heavy reduction and temper rolling with a light reduction. A temper rolling configuration preferably utilizes a larger work roll size. Larger work rolls allow for a longer work roll life, a faster rolling operation, favorable strip shape, and better rolling feasibility. In contrast, the mono block Cluster mill is unattractive for a mill that is capable of both temper and cold rolling operations. In particular, the small work roll diameter range is unsuitable for a mill configured to do both types of rolling.

The mono block design has a poor ability to thread the mill due to the small roll opening. It is difficult for the beginning end of the strip to always be flat and suitably ready to conveniently enter a small roll gap. The strip may be reluctant to enter the roll gap bite due to minor entry strip bending issues and require the manual intervention of an operator with long handled manual tools.

In a mono block design it is difficult to determine the rolling force, i.e. the vertical separation force, between the two work rolls during the rolling operation. The rolls are positioned in the rolling housing so that the vertical rolling force is dispersed into the mono block by several rolls. This highly restricts the ability to measure the rolling force with accuracy. It is desirable to measure the rolling force and use it to improve yield by more accurate rolling to the correct gauge in the initial setup.

The mono block is not designed for a convenient and accurate tilting arrangement when there is a significant side to side gauge variance in the metal strip, that is, a wedge shaped strip. Depending upon the upstream hot rolling operation, a metal strip will often have a moderate thickening in the middle of 1 to 5% of the nominal gauge. After hot rolling, the strip may be slit into two halves (or more) for further downstream processing which includes rolling on a Cluster mill. This presents a wedge shaped strip to the Cluster mill with an unpredictable thickness across the width. Since the mono block does not have a rolling force measurement, it is difficult to make an accurate side to side rolling gap correction. The rotation of the crown eccentric rings used for profile control do not provide enough tilting capability. Consequently, a wedge shaped strip will have other problems in rolling which include strip breakage, creating camber, creating centerbuckle, creating uneven edge wave, and creating other unusual strip flatness problems.

Others have recognized operational problems of the mono block design and attempted improvements. For example, U.S. Pat. No. 5,857,372 describes a split housing and prestress rod arrangement with the goal of improving various operational problems. The methods utilized are mechanically complicated, expensive to machine, and do not allow for the rapid roll opening needed to prevent damage when the strip breaks.

The design does not consider tilting of the mill. Also, the ability to adjust passline is very restricted and is equivalent to a mono block design.

U.S. Pat. No. 5,996,388 considers the use of hydraulic cylinders to prestress a rolling cage useful in a hot bar rolling operation. The design is unsuitable for a high mill stiffness to take advantage of a simplified, satisfactory commercial gauge control system in a flat rolled product. The methods utilized are mechanically complicated, expensive to machine, and do not allow for the rapid roll opening needed to prevent damage when the strip breaks. The design does not consider tilting of the mill or passline adjustment.

U.S. Pat. No. 6,260,397 considers the need to provide operational improvements that are not available with a mono block. The design does not take advantage of the mono block stiffness, but rather adds an additional pair of larger mill housings which greatly adds to the expense of the mill. The design does not use the simplified gauge control available with a mono block, and is not a prestress design. The design has a relatively low mill stiffness which requires a complicated gauge control system.

BRIEF SUMMARY OF THE INVENTION

It is a primary object of the present invention to provide a pre-stressed rolling mill which has the advantages of a conventional mono-block mill housing, utilizing a Cluster mill gauge control system, and overcomes limitations and operational problems just described. It is highly desirable to have a rolling mill with a high apparent mill stiffness, a simplified gauge control system, a large work roll gap opening for threading, a rapid work roll gap opening method, a roll force measurement, satisfactory side to side tilting, and is able to use the work rolls over a much wider diameter range. Such a mill is capable of operating satisfactorily as a commercial temper mill and a commercial cold mill.

BRIEF DESCRIPTION OF THE SEVERAL VIEWS OF THE DRAWING(S)

DETAILED DESCRIPTION OF THE INVENTION

The present invention utilizes the existing method of controlling the gauge at the exit of the cluster mill by rotating screwdown eccentric rings in the backing assemblies. This method is widely accepted commercially and is very preferable for commercial reasons. To that end, adding additional features and improvements preferably utilize a highly stiff mill to incorporate the existing gauge control method. U.S. Pat. No. 5,471,859 "Background Art" describes the use of eccentric rings or shafts on supporting roll bearings which are adjusted by a shaft and gearing system on either side of the rolling mill. The "Background Art" of U.S. Pat. No. 5,471,859 is incorporated by reference herein. The gauge control system where the exit gauge is substantially controlled by movement of at least one support roll bearing position by use of a rotating eccentric is herein called "eccentric bearing."

For the purposes of this application, the side of the mill where the operator generally controls the mill will be called the "operator side" or "front side." The opposite side is called the "drive side" or the "back side." The two sides are divided by the lengthwise direction of the metal strip. The rolls used for the rolling operation are nearly always inserted into the mill housings from the operator side.

Figure 1:
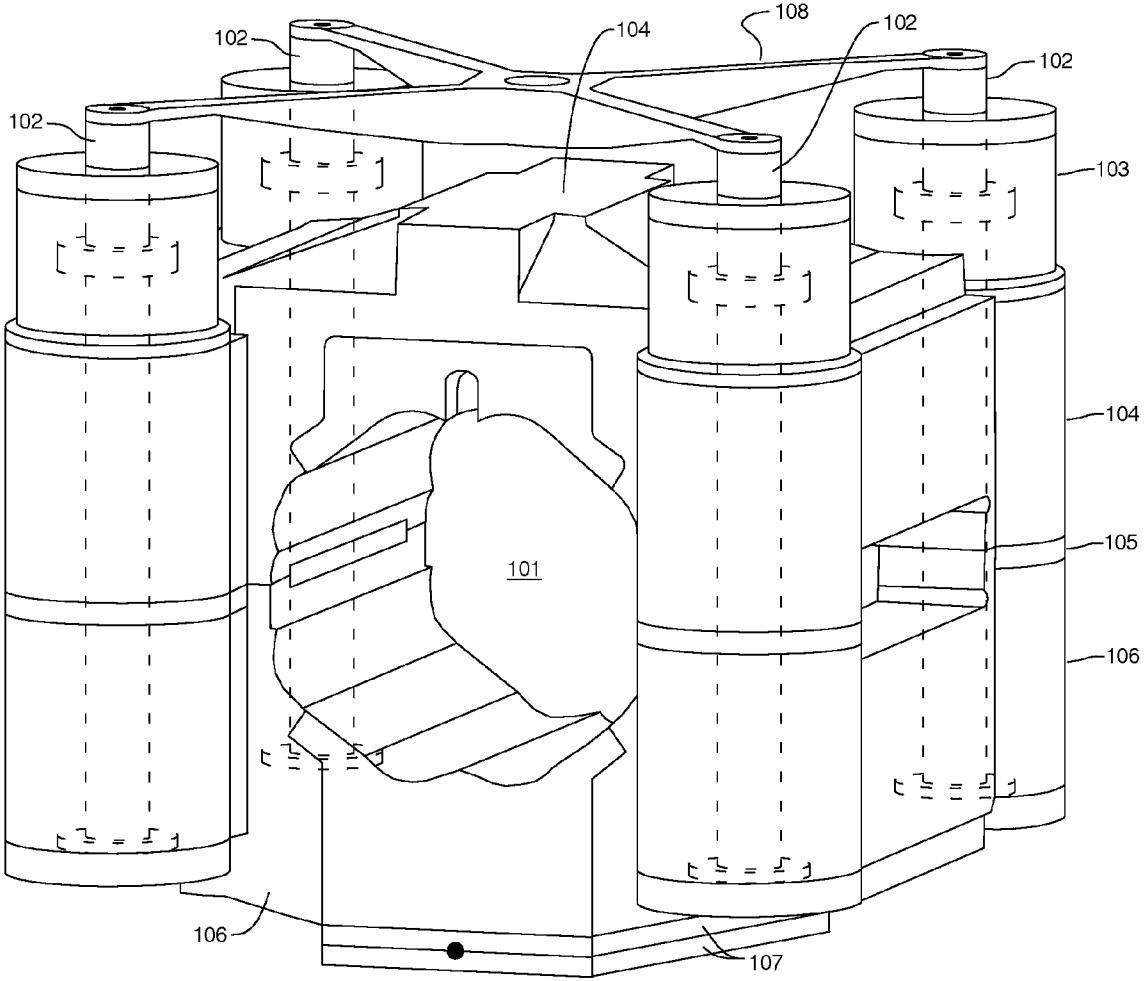
FIG. 1 is a general arrangement of a preferred embodiment of the present invention suitable for a cold rolling operation.

FIG. 1 is a general arrangement of a preferred embodiment of the present invention suitable for a cold rolling operation. The cluster rolls are removed from the mill window area 101 to simplify the illustration. Four prestress rods 102 span the length between an upper mill housing 104 and lower mill housing 106. A typical prestress rod 102 protrudes slightly above an upper hydraulic cylinder 103 that is rigidly attached to the upper mill housing 104. A lower hydraulic cylinder 105, rigidly attached to the lower housing 106, is used to create a separation distance between the upper mill housing 104 and lower mill housing 106. A wedge adjustment block 107 is located below the lower mill housing 106 to adjust the elevation of the lower mill housing 106, which in turn, adjusts the strip passline. Alternately, the passline could be adjusted by a mechanical screw, hydraulic cylinder, a motorized gearing arrangement, or an electro-mechanical positional device. The upper mill housing 104 vertically slides on the prestress rod 102 and the vertical movement may include a slight tilt from the front side to the back side.

The four prestress rods are shown to be located at the four corners of the upper and lower mill housings. The exact location of the prestress rods is not critical. But it is very preferable that one prestress rod is located in each of the four quadrants defined by the lengthwise direction of the metal strip and the work roll rotational centerline, as seen in a top view looking downward. The term "four corners" is understood to mean in each quadrant. Normally the prestress rods will be substantially symmetrical with respect to the work roll rotational centerline and the metal strip centerline, but this is not a requirement.

Before the rolling operation, and after threading the mill, the upper hydraulic cylinder creates tension in the prestress rod, which in turn, causes the upper and lower mill housings to be forced together. The force creates a compressive stress in each housing. The prestress force is chosen so that the rolling force created in the work roll bite will reduce, but not eliminate, the compressive stress in the housings.

To ensure smooth movement of the upper housing on the four prestress rods, a stabilizing bar 108 is used to keep the rod positions vertical. The attachment may be a rigid bolt, pin, or ball connection. The purpose of the stabilizing bar is to keep the four prestress rods vertical and spaced correctly to a suitable tolerance that will allow smooth movement of the upper housing on the prestress rods.

Figure 2:
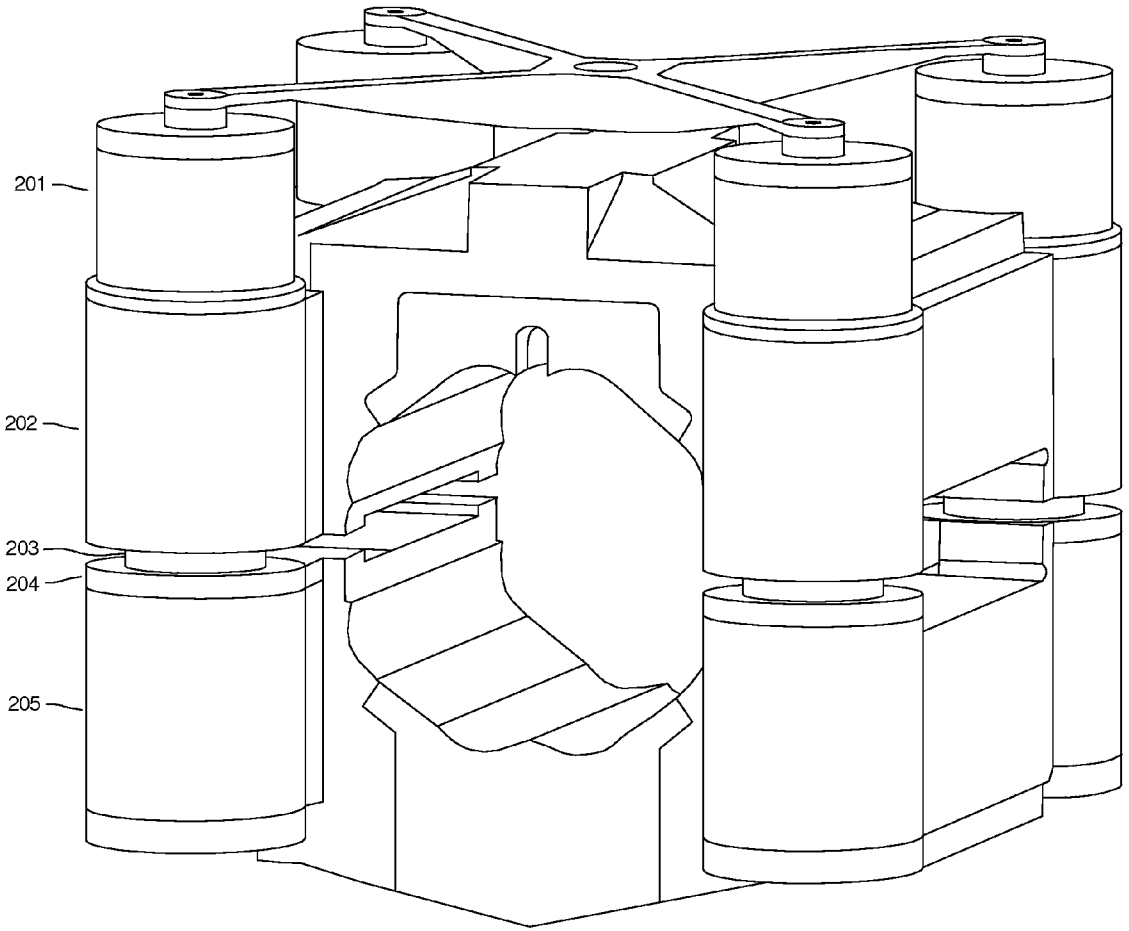
FIG. 2 is a general arrangement of a preferred embodiment of the present invention suitable for a temper mill rolling operation.

FIG. 2 is a general arrangement of a preferred embodiment of the present invention where a larger work roll may be used. The upper mill housing 202 is elevated above the lower mill housing 205 due to the piston 203 from the lower hydraulic cylinder 204. The upper cylinder 201 still provides a tensioning force in the rod. The piston 203 separates the upper and lower mill housings by use of a hydraulic position control system. Therefore the prestress of the upper and lower mill housings is maintained. The upper and lower hydraulic cylinders will be additionally described later.

The upper hydraulic cylinders may also be called prestress cylinders. The lower hydraulic cylinders may also be called spacer cylinders.

Figure 3:
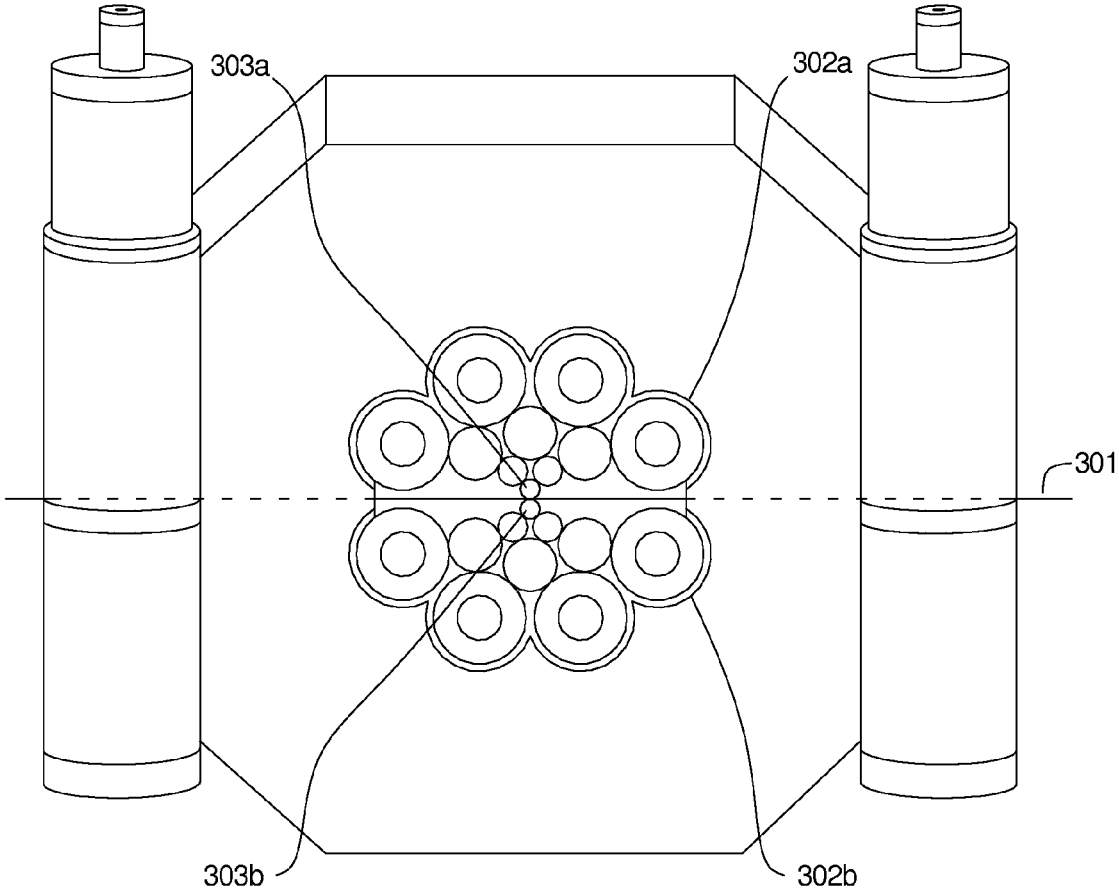
FIG. 3 is a typical cluster roll arrangement in the upper and lower mill housings.

FIG. 3 is a general arrangement of a typical 20 roll cluster arrangement in a preferred embodiment of the present invention. The passline 301 is in the middle of the roll cluster, and the upper 10 rolls are connected to the upper housing through upper roll suspension mechanisms 302*a*. The upper 10 rolls move with the upper mill housing, which slides on the prestress rod. The lower 10 rolls are connected to the lower housing through lower roll suspension mechanisms 302*b*. The work rolls 303*a*, 303*b* are the two rolls that contact the flat metal surface.

Alternately, in other embodiments, other numbers of rolls could be used in the mill housing, such as 6, 12, 16, 18, 20, and 30 rolls. The twenty roll cluster arrangement shown in FIG. 3 is only one example.

Figure 4A:
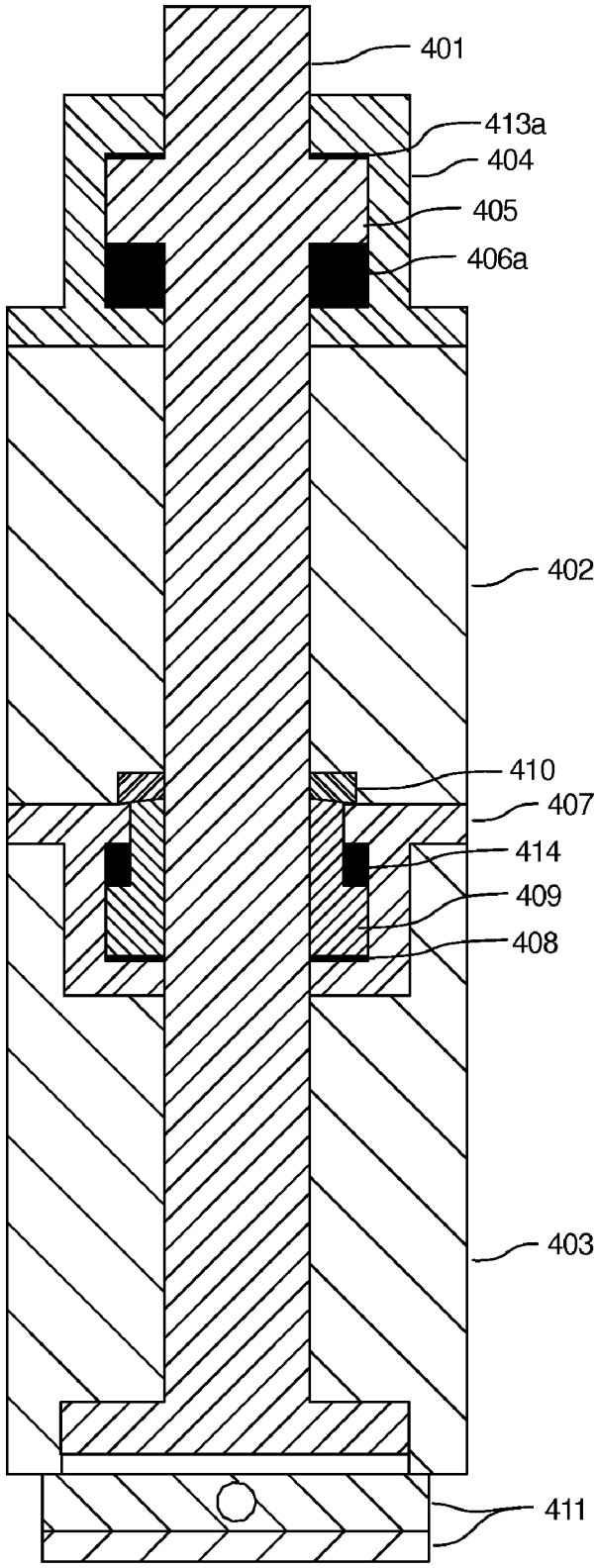
FIG. 4A-4B is a general arrangement of a prestress rod.

FIG. 4A shows a preferred embodiment of a prestress rod. The view is a vertical cut. A vertical prestress rod 401 is inside a lower mill housing 403 which is rigidly attached to the prestress rod 401. An upper mill housing 402 slides vertically along the prestress rod 401. An upper hydraulic cylinder 404 which is attached rigidly to the upper mill housing 402 is used to create a vertical load on the prestress rod by providing a hydraulic pressure in chamber 406*a* and venting hydraulic pressure in chamber 413*a*. A cylinder piston 405 is rigidly attached to and integrated onto the prestress rod 401 by machining, welding, threading, or other means. When pressure is applied to chamber 406*a*, the prestress rod 401 causes the upper housing 402 and lower housing 403 to be forced together, and thereby, prestresses the rolling mill housings. The prestress may be developed through contact between the wear plate 410 and the lower cylinder piston 409 if it is utilized through hydraulic pressure in chamber 408 and venting hydraulic pressure in chamber 414, or the upper housing 402 may directly contact the lower hydraulic cylinder 407. Alternately, low hydraulic pressures can be supplied in chambers 413*a* or 414 rather than venting to avoid air entrapment.

The prestress force is generated by a significant hydraulic pressure in chamber 406*a*. For example, a maximum pressure might be 5,000 psi, but other designed pressure limits may be chosen. The hydraulic pressure may be employed to provide a prestress force that will exceed the expected rolling force. This force will cause the upper housing 402 to be pressed against the lower housing 403 through the lower hydraulic cylinder 407 which is rigidly attached to the lower housing 403. The prestress force will maintain a very stiff mill housing, similar to a mono block, when a rolling force in the work roll bite is generated.

If the lower hydraulic cylinder is completely retracted for a particular rolling application, the upper housing may be pressed against the lower housing through the outside plate of the lower hydraulic cylinder. Alternately, the outside plate of the lower hydraulic cylinder may be recessed within the lower housing, and the upper and lower housings are in direct contact with each other.

A lower passline adjustment system 411 is used to adjust the position of the lower housing to maintain a consistent location of the work roll bite. This is normally referred to as maintaining the same passline. The lower passline adjustment system is shown under the prestress rod, but this is only one possible embodiment. FIG. 1 shows a preferred location for the passline adjustment system. The thickness, i.e. height, of the passline adjustment system 411 is adjustable by means that rotate, push, or pull two wedge plates together, and includes use of a hydraulic cylinder, electric motor, hydraulic motor, screw mechanism, hand wheel, and the like. Other vertical jacking methods may be successfully deployed and include various screws, gearing, and rotational devices.

A wear plate 410 is bolted into the top housing 402. It preferably contacts with the lower cylinder piston 409 except when the mill is fully opened. Both the wear plate 410 and the lower cylinder piston 409 have a matching machined spherical surface to allow the top housing to rock on the lower cylinder piston. The spherical surface may have a large machined diameter, such as 25 inches. The use of a wear plate is not required, but is a preferred embodiment. Alternately, the wear plate may be integrated onto the lower cylinder piston which presses against a matching surface on the upper housing.

Figure 4B:
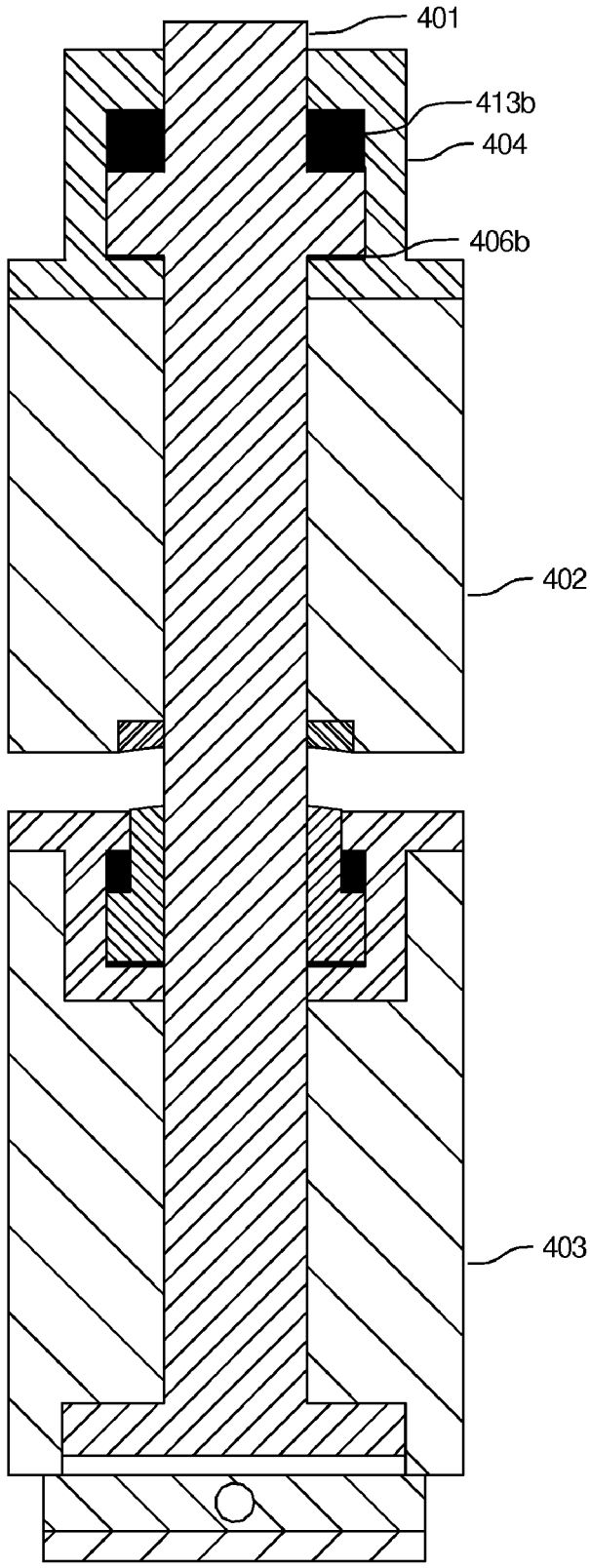

FIG. 4B illustrates how the upper hydraulic cylinder 404 is used to rapidly create an opening in the work roll bite by rapidly moving the upper mill housings 402 away from the lower mill housing 403. Hydraulic pressure is provided to chamber 413*b* and vented from chamber 406*b* to lift the upper mill housing through the attached upper hydraulic cylinder. The opening speed between the two work rolls is preferably capable of at least ⅛ inches per second for the purposes of an emergency stop when the strip breaks, and can be selected when designing the hydraulic system.

It must be understood that particular details of the prestress rod 401 and upper hydraulic cylinder are not shown in the simplified FIGS. 4A and 4B. It is desirable to disassemble the upper hydraulic cylinder from the prestress rod, and allow the upper housing to be lifted off of the lower housing to improve maintenance access to the lower hydraulic cylinder. This can be accomplished by designs of the upper hydraulic cylinder that allow convenient disassembly. Also, the upper hydraulic cylinder piston is preferably threaded onto the prestress rod. Alternately, the prestress rod may be two pieces that are screwed together below the upper hydraulic cylinder. Also, details of various hydraulic oil seals are not shown as they are known in the art.

For improved maintenance access, the upper housing 402 and lower housing 403 portions that are illustrated in FIGS. 4A and 4B may be further detached from the remainder of the mill housing. This design will allow the entire prestress rod to be removed to a machine shop for repair.

Figure 5A:
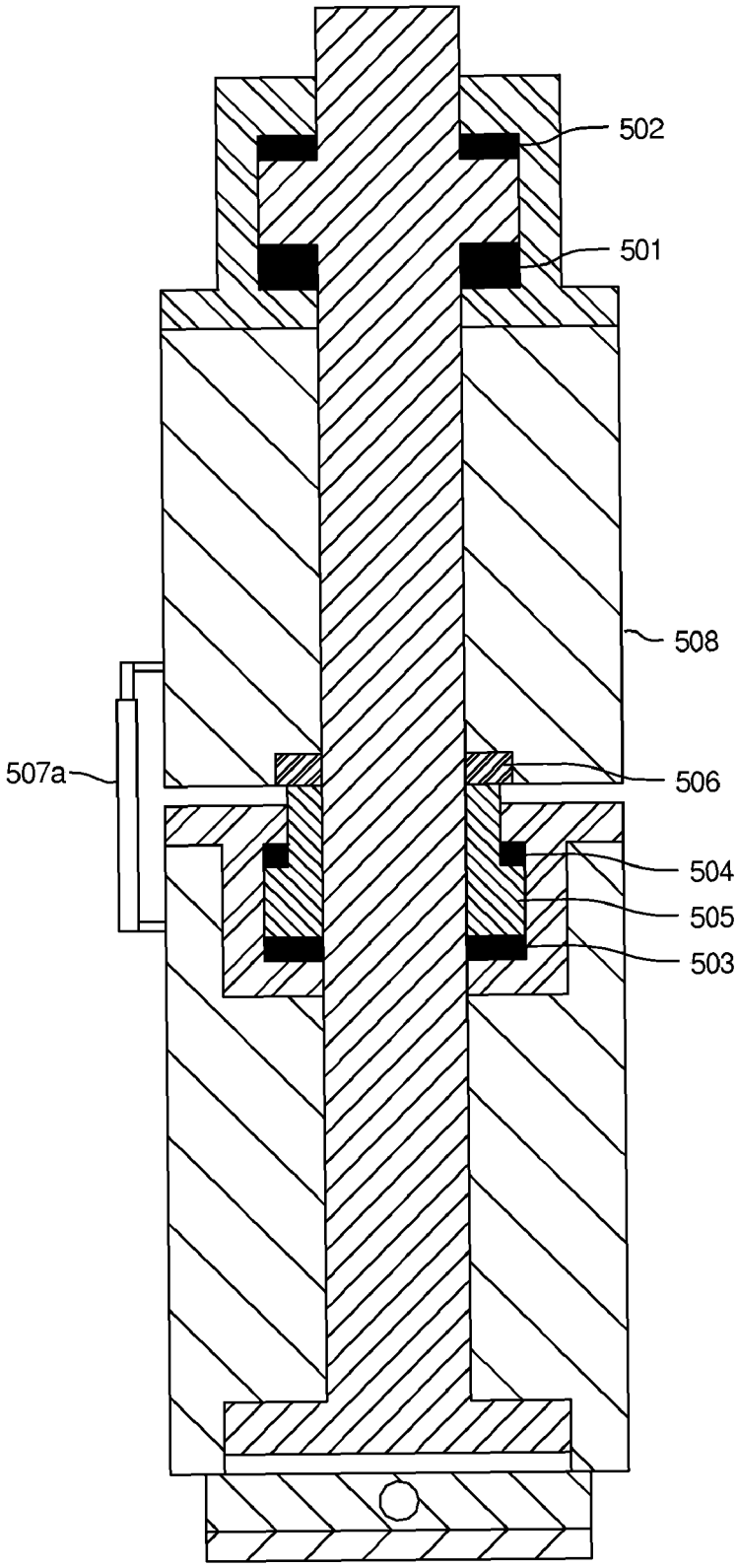
FIGS. 5A-5C show how the prestress rod is used in various rolling and opening configurations.

FIG. 5A shows how the prestress rod is used when the lower hydraulic cylinder piston is employed. The lower hydraulic cylinder is activated by a pressure in chamber 503 and a venting the pressure in chamber 504. This moves the lower cylinder piston 505 vertically into the upper housing wear plate 506 which lifts the upper housing 508. A tensile force in the prestress rod is employed by a hydraulic pressure in chamber 501 and by venting the hydraulic pressure in chamber 502. The upper hydraulic cylinder and lower hydraulic cylinder are then opposing each other. To stabilize the position of the upper housing relative to the lower housing, a highly responsive and accurate position sensor 507*a* is used to control the hydraulic pressure in chamber 503 so that the piston 505 can reach an operator selected position.

Preferably the position sensor 507*a* is highly accurate with a position resolution of less than 0.0001 inches. Preferably it is also highly responsive with a sensing time constant less than 100 milliseconds. The time constant is the time it takes for the sensor's step response to reach 63% of its final value. The sensor may be mechanical, optical, electronic, magnetic, capacitance, laser based, or a combination. The sensor may be incorporated inside the mill housing rather than an external mounting as shown in FIG. 5A. The sensor is preferably designed and mounted to avoid backlash, tolerance connecting issues, or other problems that will lower sensor accuracy and response.

The hydraulic pressure in chamber 503 is preferably controlled by a highly responsive hydraulic system that is capable of regulating the hydraulic pressure in chamber 503 to a very closely controlled level. A servo valve, proportional valve, solenoid servo valve, or other similar responding hydraulic valve may be employed with success. Preferably, the time constant of the hydraulic control in pressure chamber 503 is no more than 50 milliseconds. The hydraulic controlling valve is preferably employed in a complete hydraulic system with suitable support equipment including accumulators in close proximity. In another preferred embodiment, the control loop response for chamber 503 is faster than the automatic gauge control response to ensure stability of the overall gauge control system. Typically, the automatic gauge control system response in a mono block cluster mill has a time constant of about 30-100 milliseconds, and the control loop response for chamber 503 can be suitably matched with a faster response.

The amount of hydraulic pressure in chamber 501 is based on the amount of prestress required to exceed the vertical rolling force at the work roll bite. The force must be great enough to keep the upper housing 508 in complete contact with the upper housing wear plate 506 and the lower hydraulic cylinder piston 505. When combined with the highly accurate and responsive position control of the lower hydraulic cylinder, the apparent mill stiffness will be very comparable to a cluster mill mono block. The hydraulic pressure in chamber 501 is hydraulically blocked off during the rolling operation and will vary based on rolling forces. Hydraulic pressure in chamber 502 is substantially vented or operated at a low pressure during the rolling operation to prevent air entrapment.

During the rolling operation, the lower cylinder will be controlled to maintain a constant position, and is not used to provide gauge control of the exit strip. Due to the prestress force from the upper hydraulic cylinder, the prestressed split mill housing provides a stiffness very comparable to the mono block mill housing. When used in a gauge control system, the current invention will effectively have 90-95% of a mono block stiffness.

In a preferred embodiment, the same hydraulic pumps are used to supply both the lower hydraulic cylinder control and upper hydraulic cylinder control.

Figure 5B:
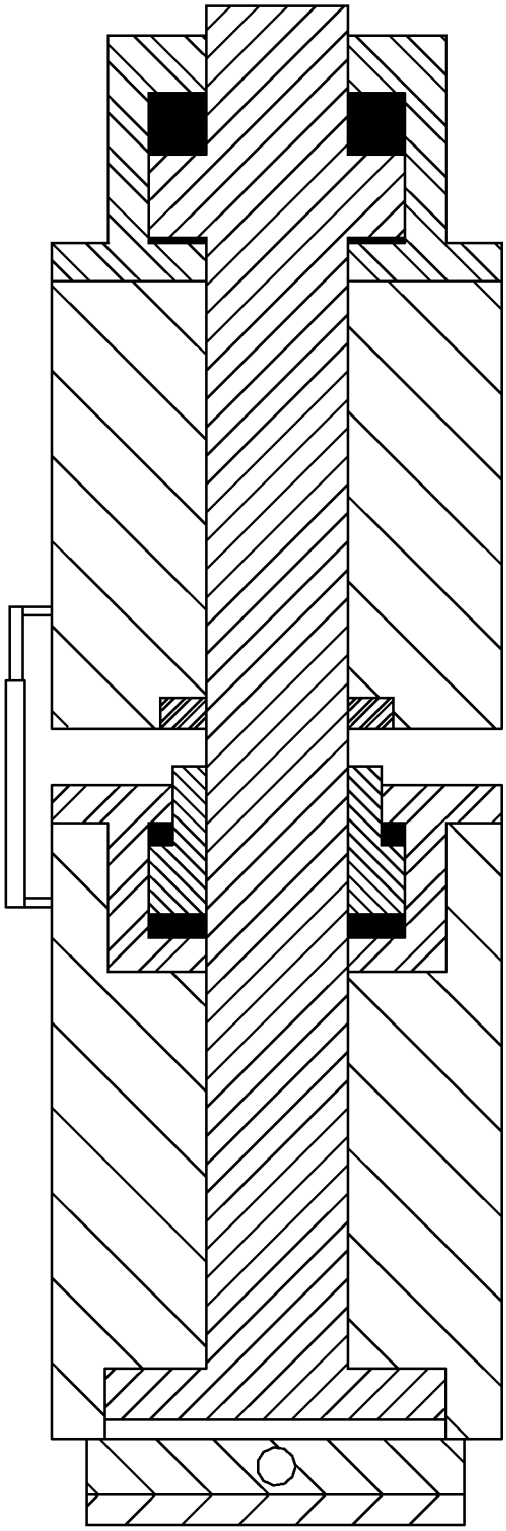

FIG. 5B is similar to FIG. 4B where the upper hydraulic cylinder is used to rapidly create an opening in the work roll bite by rapidly moving the upper mill housings away from the lower mill housing. The speed of separation is preferably at least ⅛ inches per second to minimize potential damage to the rolls and equipment.

Figure 5C:
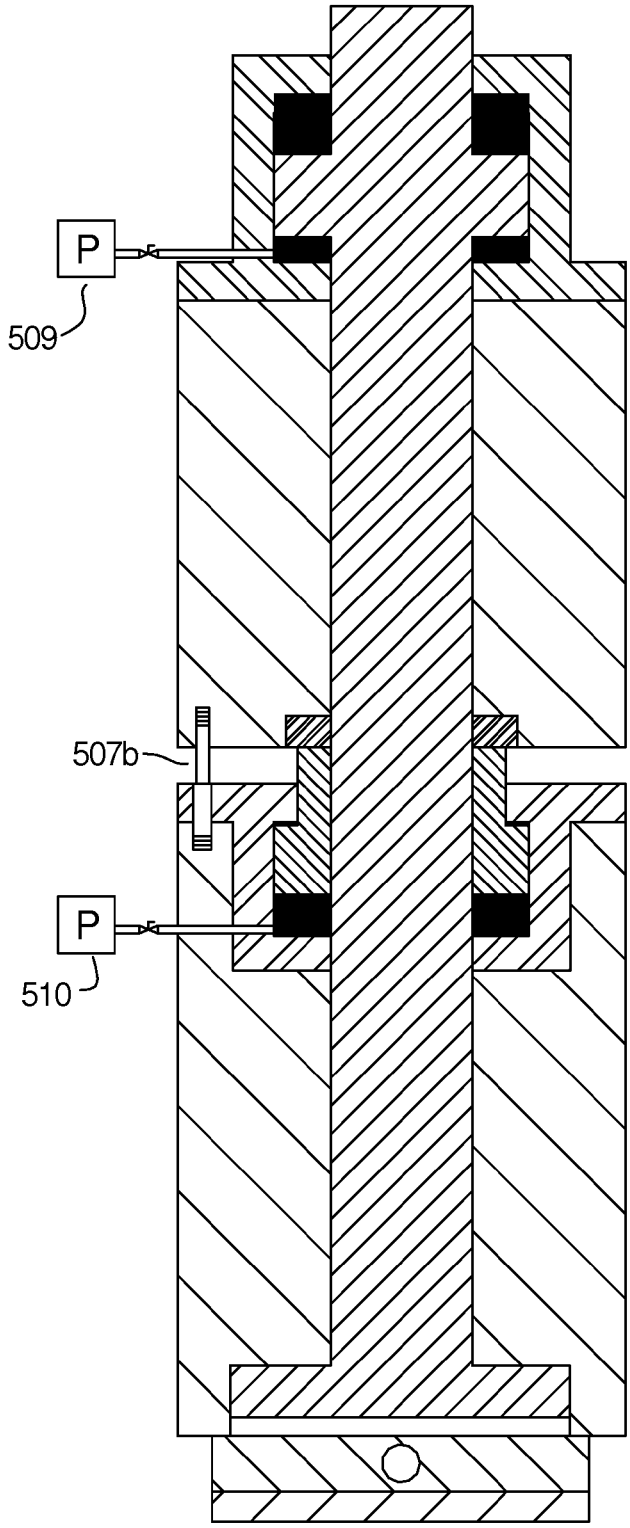

FIG. 5C is similar to FIG. 5B except that the lower hydraulic cylinder is used to create the rapid mill opening. In a preferred embodiment and slightly different than FIG. 5B, the ends of position sensor 507*b* are encompassed inside the upper mill housing and lower mill housing.

FIG. 5C additionally illustrates the placement of pressure measuring instrumentation on the upper and lower hydraulic cylinders. Pressure transducer 509 monitors the upper hydraulic cylinder pressure that creates the prestress load and pressure transducer 510 monitors the lower cylinder. In a preferred embodiment, at least one upper hydraulic cylinder and at least one lower hydraulic cylinder are monitored for pressure during the rolling operation. Additional transducers may be applied on both sides of each hydraulic piston if desired.

The control system of the mill during the rolling process is relatively simple. As an overview, the upper hydraulic cylinder is initially loaded to a desired pressure to create a prestress rod tension. The hydraulic valve that feeds the upper cylinder is then closed off for the rolling operation, that is, it is hydraulically blocked. The upper cylinder pressure is then allowed to naturally vary due to the gauge control and thickness variances of the incoming metal strip. The upper hydraulic cylinder pressure is not adjusted by a control loop, which prevents it from causing control conflicts with the gauge control system. The lower hydraulic cylinder is operated on a position mode control loop, as previously described, in all cases based on the desired opening between the upper and lower mill housings. The control of the exit strip gauge is by eccentric bearings.

The position of the lower hydraulic cylinder during the rolling operation may be chosen within a range that is suitable for the eccentric bearing operating range. For example, after a roll change, the eccentric bearing can be rotated to the position calculated by the set up program. This establishes a zero position. If the large work roll is applied, the distance between top and bottom housings must be greater. The passline adjustment system, located at the bottom of the mill, will lower the mill housings to maintain the pass line based on the set up program.

Also, the present invention can be used for rolling with a mill tilting function. The lower hydraulic cylinder can be raised a very small amount, such as 0.010" or 0.050", to provide room for the upper housing to tilt within a suitably large operating range. If mill is not to be tilted, then the upper cylinder may be lowered so that the upper and lower mills are touching. The mill will operate the same as a mono-block after pre-stressing is employed.

When the mill is used as a temper mill and utilizes larger work roll diameters, the lower hydraulic cylinder will be raised and the tilting function can be accomplished easily. The ability to adjust the side to side position of the lower hydraulic cylinder is a distinct advantage of the present invention.

Frequently there are diameter issues with new rolls or the regrinding of worn rolls. The present invention provides for utilizing rolls with a larger diameter on one end, i.e. a tapered roll, without significant impact on metal strip shape or gauge, when compared to the mono block mill.

As already stated, existing cluster mill housings often have a very limited work roll range. This limitation is due to the mono-block mill housing limited vertical space. This present invention allows for continuous work roll diameter variances for reduction and temper rolling thanks to the additional space provided by spacer cylinders. Operational work roll diameter ratios of 1.5 to 3 are now possible where a maximum work roll diameter is 50% to 200% larger than the minimum work roll diameter in the present invention which is not possible in previous mono block mill housing methods. Previous mono block housing methods typically only allow a 10-20% diameter range, and in some select cases up to a 50% diameter range. The present invention provides for a larger range of work roll diameters that may be conveniently used in the mill operation. The work roll diameter range may vary based on the intended rolling mill operational design.

The present invention is fully capable of rolling the flat metal strip to desirable tight commercial tolerances. Preferably, the centerline exit gauge (or thickness) is within 1% of the target exit gauge for over 95% of the incoming strip length. The present invention is applicable to a wide variety of commercially rolled flat metals in thicknesses and materials that are commonly rolled in cluster mills.

Some operators tend to view the rolling mill as operating at a constant steady state or constant condition. In fact, there are a number of important and ongoing changes during the rolling process. The work rolls normally heat up and expand which changes the rolling force. The incoming strip may have unexpected thickness or shape variances. The friction in the roll bite changes due to roll wear, lubrication changes, speed changes, and changes in rolling force. Suitable corrections must be made on an ongoing basis to provide satisfactory commercial operation. Often the changes are relatively minor and various control loops are employed to make suitable corrections to keep the mill rolling within commercial tolerances.

In general, all four lower hydraulic cylinders and all four upper hydraulic cylinders are operated in a coordinated fashion, and any position or pressure changes are normally applied evenly. However, tilting is coordinated from the front (operator) side to the back (drive) side and each side may be moved in a different direction. Often they are moved by an adjustment that is equal in magnitude but opposite in direction. Additionally, each side may be coordinated to maintain the same rolling force within a particular range to provide for a better shape control.

The rolling force can be determined during the steady state rolling condition by the difference in the force generated by the upper and lower hydraulic cylinders when considering the weight of the upper mill housing, the weight of the upper rolls, and the weight of any equipment attached to the upper mill housing. The hydraulic pressure in the upper and lower hydraulic cylinders may be monitored by pressure transducers to facilitate a computation. A calculation and can then be performed during the rolling operation and a display of the rolling force shown to an operator.

It is a distinct advantage of the present invention to be able to determine the overall rolling force-deflection curve of the mill for gauge control and rolling purposes. In the case of a mono block, it is difficult to determine the force-deflection curve as the vertical rolling force at the work roll bite is not reasonably measurable. In the present invention, the force-deflection curve is relatively easy to measure utilizing the upper and lower hydraulic cylinders. The curve, and the mill stiffness which is thereby determined, is very useful for proper setup of the mill to ensure rapid and accurate gauge control when starting the rolling operation. The ability to improve the initial operating parameters of the rolling process for a variety of roll and rolling conditions is helpful to improve process yields.

Figure 6:
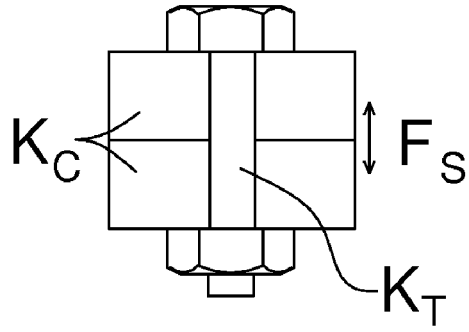
FIG. 6 is a graph showing a deflection force curve illustrating how the present invention cluster mill housing assembly stiffness is a combination of the housing and prestress rod stiffness.
Figure 6:
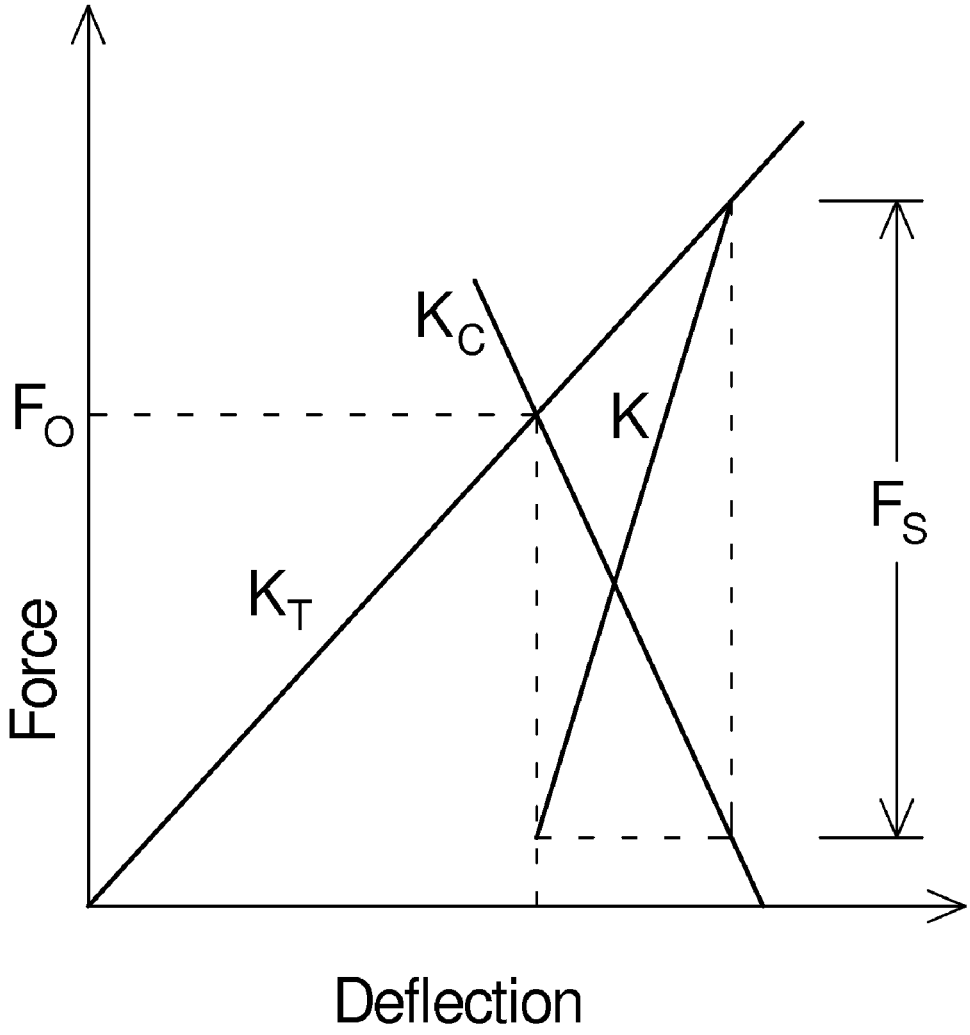

The rolling force-deflection curve may be obtained in a calibration method in the offline state. A preferred method is to retract the lower cylinders, prestress the upper and lower housing together with a preselected upper hydraulic cylinder pressure, and then separate the upper mill housing from the lower mill housing by raising the lower cylinders. The separation distance between the two housings, along with the known prestress hydraulic pressure, is then used to determine the mill modulus of the housings. When the housing modulus is combined with the known modulus of the round prestress rod shaft, the overall prestressed assembly modulus is then known. Once the overall prestressed assembly modulus is known, as illustrated in FIG. 6, the force-deflection curve is known. Additionally, once either of the upper or lower hydraulic cylinder pressures are known, the rolling force can then be determined by calculation.

In reference to FIG. 4, the lower (spacer) cylinder 407 and piston 409 are used to steer the mill, that is, to provide the tilting function from the front side to the back side, as already described. The tilting function allows for changes to the rolling pressure across the strip width, and allows for rolling a strip that has a thicker edge on one side. Preferably, the upper cylinders do not provide the side to side tilting function, but allow the lower cylinders to provide the tilting function.

When the strip is initially fed into the rolling mill during threading, the upper hydraulic cylinder may be operated at a reduced pre-stress level, normal operating pre-stress level, or at a full mill open condition depending upon the type of material and thickness being threaded to facilitate easy threading. Similarly, the lower hydraulic cylinder position may be coordinated to support the operation of the upper hydraulic cylinder to provide easy threading.

FIG. 6 is a graph showing when two pieces are bolted together with a pre-stress load $F_O$, they behave as though they are one piece together. The external force $F_S$ (rolling force in this invention) leads to additional stretch of the tensile rod and to "un-compress" the compressive parts (housings in the invention). Based on the calculation, that is, the overall mill modulus ($K=K_C+K_T$) is larger than either of the mill housings ($K_C$) or the prestress tension rod ($K_T$).

In the case of the present invention, the hydraulic fluid in either the upper hydraulic cylinder or lower hydraulic cylinder do not cause a significant lowering of the mill stiffness when compared to a mono block. The rapid hydraulic control system in the lower hydraulic cylinder in conjunction with the pre-stress housing concept provides a very high stiffness when compared to the need to correct the gauge in the mill.

In the case of the present invention, the hydraulic fluid in either the upper hydraulic cylinder or lower hydraulic cylinder does not cause a significant lowering of the mill stiffness when compared to a mono block. The rapid hydraulic control system in the lower hydraulic cylinder (operated in position mode with much higher speed than the AGC control loop) provides a very high stiffness when compared to the needed timing of gauge corrections in the rolling mill bite. The hydraulic oil used in either of the upper hydraulic cylinder or the lower hydraulic cylinder, may be a higher bulk modulus fluid, such as glycol, to increase the rigidity of the system.

While various embodiments of the present invention have been described, the invention may be modified and adapted to various operational methods to those skilled in the art. Therefore, this invention is not limited to the description and FIGURE shown herein, and includes all such embodiments, changes, and modifications that are encompassed by the scope of the claims.

I claim:

1. A cluster mill housing assembly for a rolling operation to reduce a gauge of a flat metal strip, the assembly comprising:

a. a first housing, having a plurality of corners, wherein said first housing has a roll cavity configured to receive a first plurality of rolls, b. a second housing, wherein said second housing has a roll cavity configured to receive a second plurality of rolls, c. a plurality of vertical prestress rods, wherein at least one of said vertical prestress rods is located at each of the plurality of corners of said first housing and at each of the corresponding corner of said second housing, wherein said first housing moves vertically relative to said vertical prestress rods, wherein each of said plurality of vertical prestress rods is rigidly attached to said second housing, d. a hydraulic tensioning and positioning control system that includes a first plurality of hydraulic cylinders, each including a piston, each said piston being connected to one of said plurality of vertical prestress rods, wherein said first plurality of hydraulic cylinders is connected to said first housing, wherein said first plurality of hydraulic cylinders is used to create a respective predetermined tensile load in each one of said plurality of vertical prestress rods, wherein said predetermined tensile loads are at least large enough to create a compression stress in both said first housing and said second housing during said rolling operation, wherein said hydraulic tensioning and positioning control system is operable to increase a vertical separation between said first housing and said second housing in the event of a break in said flat metal strip during said rolling operation, wherein said hydraulic tensioning and positioning control system further includes a second plurality of hydraulic cylinders operatively connected to the cluster mill housing assembly, wherein each one of said second plurality of hydraulic cylinders includes a piston, wherein said hydraulic tensioning and positioning control system includes a hydraulic position control system operatively coupled to said second plurality of hydraulic cylinders and configured to vertically position and maintain said first housing relative to said second housing during said rolling operation to set a predetermined gap between said first housing and said second housing, and e. a distance sensor system operatively coupled to said cluster mill housing assembly, wherein said distance sensor system measures a distance between said first housing and said second housing at each one of two selected points.

2. The cluster mill housing assembly according to claim 1 wherein said second housing is lower than said first housing, further comprising a vertical position adjustment system located under said second housing, and said vertical position adjustment system is operable to change the vertical position of said second housing.

3. The cluster mill housing assembly according to claim 2 wherein said vertical position adjustment system utilizes at least one from the group consisting of a wedge, hydraulic cylinder, electric motor, hydraulic motor, screw mechanism, hand wheel, screws, and gearing.

4. The cluster mill housing assembly according to claim 1, further comprising said first plurality of rolls and said second plurality of rolls, wherein a combined count of said first plurality of rolls and said second plurality of rolls is a number selected from the group consisting of 6, 12, 16, 18, 20, and 30.

5. The cluster mill housing assembly according to claim 1 wherein said first hydraulic control system is configured to control said second plurality of hydraulic cylinders to control a tilt between the first housing relative to the second housing during said rolling operation.

6. The cluster mill housing assembly according to claim 1 wherein said first plurality of hydraulic cylinders is operable to increase a vertical separation between said first housing and said second housing at a rate of at least ⅛ inches per second if a break occurs in said flat metal strip during said rolling operation.

7. The cluster mill housing assembly according to claim 1, further comprising a pressure transducer operatively coupled to at least one of said first plurality of cylinders and operable to obtain a pressure measurement from at least one of said first plurality of hydraulic cylinders, and a pressure transducer operatively coupled to at least one of said second plurality of cylinders and operable to obtain a pressure measurement from at least one of said second plurality of hydraulic cylinders, wherein said measurements are used to determine a rolling force during said rolling operation.

8. The cluster mill housing assembly according to claim 1 wherein said first plurality of hydraulic cylinders are hydraulically blocked during said rolling operation.

9. The cluster mill housing assembly according to claim 1 wherein said second plurality of hydraulic cylinders are controlled by a first hydraulic control system with a time constant of no more than 50 milliseconds.

10. The cluster mill housing assembly according to claim 1 wherein said rolling operation achieves a centerline exit gauge within 1% of a preselected target thickness for over 95% of the entry strip length.

11. The cluster mill housing assembly according to claim 1, further comprising a plot-generation system operatively coupled to the cluster mill housing assembly, configured to receive a measurement value of a first hydraulic pressure in said first plurality of hydraulic cylinders, a measurement value of a second hydraulic pressure in said second plurality of hydraulic cylinders, and including a measurement value of a separation between the said first housing and said second housing, wherein the plot-generation system is configured to plot a rolling force versus a vertical separation between said first housing and said second housing.

12. The cluster mill housing assembly according to claim 1 wherein at least one of said second plurality of hydraulic cylinders on a front side of said cluster mill housing assembly are coordinated separately from at least one of said second plurality of hydraulic cylinders on a back side of said cluster mill housing assembly for the purpose of tilting during said rolling operation.

13. The cluster mill housing assembly according to claim 1 wherein said first housing is above said second housing, wherein each one of said plurality of vertical prestress rods has a top end, the assembly further comprising a stabilizing bar, wherein the stabilizing bar is connected to the top ends of each one of said plurality of vertical prestress rods.

14. The cluster mill housing assembly according to claim 1, further comprising a hydraulic pressure measurement system configured to measure a hydraulic pressure in said first plurality of hydraulic cylinders and a hydraulic pressure in said second plurality of hydraulic cylinders, wherein the pressure measurements are used to control a rolling force in said rolling operation.

15. The cluster mill housing assembly according to claim 1 wherein said first housing can be controlled to tilt during said rolling operation.

16. The cluster mill housing assembly according to claim 1 wherein a ratio of maximum diameter of a work roll to a minimum diameter of a work roll is 3.

17. The cluster mill housing assembly according to claim 1, further comprising a control system operatively connected to rotate the at least one eccentric bearing, wherein said second plurality of hydraulic cylinders are controlled by the hydraulic position control system with a time constant less than a time constant of the control system that is used to rotate said at least one eccentric bearing.

18. The cluster mill housing assembly according to claim 1, wherein the first plurality of hydraulic cylinders are each operable in each of two directions, wherein one of the directions is operable to increase a vertical separation between the first housing and the second housing if a break occurs in said flat metal strip during said rolling operation and wherein the other direction is used to create a respective predetermined tensile load in each one of said plurality of vertical prestress rods.

19. The cluster mill housing assembly according to claim 1, wherein the second plurality of hydraulic cylinders are each operable in each of two directions, wherein the second plurality of hydraulic cylinders is operable to increase a vertical separation between the first housing and the second housing if a break occurs in said flat metal strip during said rolling.

20. The cluster mill housing assembly according to claim 1, whereby said cluster mill housing assembly is useful to reduce the gauge of said flat metal strip for commercial purposes.

21. The cluster mill housing assembly according to claim 1, wherein at least two distance sensors are operatively coupled to said cluster mill housing assembly, wherein each said distance sensor measures a distance between said first housing and said second housing.

22. The cluster mill housing assembly according to claim 1, further comprising at least one support roll eccentric bearing on each side of said flat metal strip, wherein the gauge of said flat metal strip during said rolling operation is substantially controlled by a rotation of at least one of said at least one support roll eccentric bearing on each side of said flat metal strip.

23. The cluster mill housing assembly according to claim 1, wherein each one of the second plurality of cylinders is concentrically arranged around a respective one of the plurality of vertical prestress rods.

24. A method of operating a cluster mill, the cluster mill including: a cluster mill housing assembly that includes a) a first housing, having a plurality of corners, wherein said first housing has a roll cavity housing a first plurality of rolls including a first work roll, b) a second housing, wherein said second housing has a roll cavity having a second plurality of rolls including a second work roll, c) a plurality of vertical prestress rods, wherein at least one of said vertical prestress rods is located at each of a plurality of corners of said first housing and at each corresponding corner of said second housing, wherein each of said plurality of vertical prestress rods is rigidly attached to said second housing, d) a hydraulic tensioning and positioning control system that includes a first plurality of hydraulic cylinders, each including a piston, each said piston being connected to one of said plurality of vertical prestress rods, and a second plurality of hydraulic cylinders, each including a piston, wherein said first plurality of hydraulic cylinders is connected to said first housing, the second plurality of hydraulic cylinders is operatively connected to said cluster mill, a first hydraulic control system with sufficient control response to maintain said predetermined gap, e) the said pistons in the first plurality of hydraulic cylinders capable of moving the first housing vertically, the second said plurality of hydraulic cylinders capable of setting a predetermined gap between the first and second housing, the said hydraulic sensors having sufficient control response to allow said hydraulic tensioning and positioning control system to operate said second set of hydraulic cylinders to maintain said predetermined gap, f) a distance sensor, operatively connected to said cluster mill, said sensor measures a distance between said first housing and said second housing, g) at least one support roll eccentric bearing on each side of said flat metal strip, wherein the gauge of said flat metal strip during said rolling operation is substantially controlled by a rotation of at least said one support roll eccentric bearing, the method comprising:

moving said first housing vertically relative to said vertical prestress rods;

using the hydraulic tensioning and positioning control system, hydraulically creating and controlling a respective predetermined tensile load in each one of said plurality of vertical prestress rods;

using the hydraulic tensioning and positioning control system, hydraulically creating and controlling a compression stress in both said first housing and said second housing during said rolling operation;

rolling the flat metal strip between the first and second work rolls;

maintaining the predetermined gap during rolling based on a signal output from at least one distance sensor;

using at least one eccentric bearing on each side of the strip, adjusting for and maintaining the desired output gauge; and using the hydraulic tensioning and positioning control system, increasing a vertical separation between said first housing and said second housing in the event of a break in said flat metal strip during said rolling of the flat metal strip.

25. A method of operating a cluster mill, the cluster mill including: a cluster mill housing assembly that includes a) a first housing, having a plurality of corners, wherein said first housing has a roll cavity housing a first plurality of rolls including a first work roll, b) a second housing, wherein said second housing has a roll cavity having a second plurality of rolls including a second work roll, c) a plurality of vertical prestress rods, wherein at least one of said vertical prestress rods is located at each of a plurality of corners of said first housing and at each corresponding corner of said second housing, wherein each of said plurality of vertical prestress rods is rigidly attached to said second housing, d) a hydraulic tensioning and positioning control system that includes a first plurality of hydraulic cylinders, each including a piston, each said piston being connected to one of said plurality of vertical prestress rods, and a second plurality of hydraulic cylinders, each including a piston, wherein said first plurality of hydraulic cylinders is connected to said first housing, said second plurality of hydraulic cylinders is operatively connected to said cluster mill, a first hydraulic control system with sufficient control response to maintain said predetermined gap, e) the said pistons in said first plurality of hydraulic cylinders capable of moving the first housing vertically, said second plurality of hydraulic cylinders capable of setting a predetermined gap between the first and second housing, the said hydraulic sensors having sufficient control response to allow said hydraulic tensioning and positioning control system to operate said second plurality of hydraulic cylinders to maintain said predetermined gap, f) a distance sensor, operatively connected to said cluster mill, said sensor measures the distance between said first housing and said second housing, said plurality of prestress rods each having a predetermined modulus, the method comprising:

determining a rolling force deflection curve for setting up a cluster mill prior to rolling operations, wherein the determining of the rolling force deflection curve includes: retracting said second plurality of hydraulic cylinders;

utilizing the hydraulic tensioning and positioning control system, prestress the first and second housing together based on a preselected pressure value in said first plurality of hydraulic cylinders;

separating the first and second housing said second plurality of hydraulic cylinders;

using a distance sensor, measuring the separation distance between the housings;

computing, by combining said separation distances and said preselected prestress pressure, a mill modulus for the housings;

computing, by combining said mill modulus and the known modulus from said plurality of prestress rods, an overall prestressed assembly modulus;

computing, by utilizing said overall prestressed assembly modulus, a force-deflection curve; and outputting said force-deflection curve in a form suitable for an operator to utilize during later rolling operations.

26. The method of claim 25, further comprising, during the rolling operations of the cluster mill:

a. measuring a first pressure from said first plurality of hydraulic cylinders;

b. computing a required rolling force based on said first pressure measurement and said force-deflection curve; and c. outputting said computed rolling force.

27. The method of claim 25, further comprising, during the rolling operations of the cluster mill:

a. measuring a second pressure from said second plurality of hydraulic cylinders;

b. computing a required rolling force based on said second pressure measurement and said force-deflection curve; and c. outputting said computed rolling force.

* * * * *